United States Patent [19]

Jones

[11] 4,231,196

[45] Nov. 4, 1980

[54] METHOD OF TREATING PARTS BY VIBRATORY ACTION

[75] Inventor: George F. Jones, Mishawaka, Ind.

[73] Assignee: Wheelabrator-Frye Inc., Hampton, N.H.

[21] Appl. No.: 24,119

[22] Filed: Mar. 26, 1979

Related U.S. Application Data

[60] Division of Ser. No. 887,758, Mar. 17, 1978, Pat. No. 4,161,848, which is a continuation of Ser. No. 748,953, Dec. 9, 1976, abandoned.

[51] Int. Cl.[3] ..... B24B 1/00

[52] U.S. Cl. ..... 51/313

[58] Field of Search ..... 51/163.1, 163.2, 313, 51/314, 315

[56] References Cited

U.S. PATENT DOCUMENTS

| | | | |
|---|---|---|---|
| 3,422,577 | 1/1969 | McKibben | 51/163.2 |
| 3,633,321 | 1/1972 | Rise | 51/163.2 |
| 3,724,146 | 4/1973 | Fahey | 51/163.2 |
| 3,882,643 | 5/1975 | Knartzer | 51/163.2 |

*Primary Examiner*—Harold D. Whitehead

*Attorney, Agent, or Firm*—McDougall, Hersh & Scott

EXEMPLARY CLAIM

A vibratory finishing mill of the bowl type embodying a barrier which extends as a dam across the bowl and causes the parts and media to rise from a normal level to an upper level to clear the barrier and which fall to a lower level below normal level upon clearance of the barrier to enable separation of the parts and media at a level below normal level for removal of the parts and return of the media to the bowl.

1 Claim, 4 Drawing Figures

METHOD OF TREATING PARTS BY VIBRATORY ACTION

This is a division of application Ser. No. 887,758, filed Mar. 17, 1978 and entitled "Vibratory Finishing Device", now U.S. Pat. No. 4,161,848, issued July 24, 1979, a continuation of Ser. No. 748,953, Dec. 9, 1976, now abandoned.

This invention relates to a vibratory finishing device in which parts to be finished and media are subjected, in admixture, to vibratory action for the purpose of polishing, deburring, or otherwise finishing said parts.

Parts to be finished comprise a wide variety of articles including metal castings, molded plastic parts, and the like articles of manufacture, and the media may comprise an abrasive or polishing material such as granite, aluminum oxide, sand, chipped marble, steel bars, and molded plastic pellets of smaller dimension than the parts and which also may beneficially contain a fluid or finely divided polishing material in admixture with the media to form a part thereof.

When the parts and media are vibrated in admixture in said vibratory device, the resulting action causes the surfaces of the parts to be rubbed in a polishing, abrasive, or abrading action.

For the most part, such vibratory devices comprise annular containers having a curvilinear bottom wall with axially spaced inner and outer side walls extending upwardly continuously from the ends of the bottom wall, with springs or other resilient means supporting the container to enable vibratory movements in response to rotation of one or more eccentrics distributed along the axis of the container. An elliptical movement is imparted to the parts and media for travel continuously down one side wall across the bottom and up the other side wall and back across the top as the parts and media are advanced circumferentially about the container. By reason of the circular configuration of the container, the parts and media can be allowed to recirculate in the manner of a continuous operation, in response to such vibrabory movement, until the desired surface treatment or finishing operation has been completed.

Upon completion of the finishing or abrading operation, it is necessary to separate the parts from the media for removal of the parts while the media is returned to the container for further use. Various procedures have been adopted for such separation of parts from the media. In the McKibben U.S. Pat. Nos. 3,553,900 and 3,407,542, use is made of a separation screen which overlies a portion of the bowl. When it is desired to unload the parts, an arcuate ramp is lowered into the bowl into the path of the parts and media. In response to continued vibratory action, the parts and media travel up the ramp onto the screening member. The media sifts through the screen for return gravitationally into the underlying portion of the bowl while the parts remain on the surface of the screening member from which they are carried off.

In the Ferrara U.S. Pat. No. 3,693,298, use is also made of a ramp over which the parts and media travel during vibratory movement about the bowl. When the finishing operation is completed, a screening member is inserted in endwise alignment with the ramp. The screening member retains the parts which are advanced to a delivery slot at the inner wall, while the media sifts through the screening member for return to the bowl.

In a series of Balz U.S. Pat. Nos. 3,400,495 and 3,466,815, a vertical septum or dam is located in the bowl forcing the parts and media to climb over the dam during vibratory movement in the finishing operation. Again, when the finishing operation has been completed, a screening member is introduced at an upper level to receive the parts and media overflowing the dam to separate the parts on the surface from the media which sifts through for return gravitationally to the underlying portion of the bowl.

All of these devices depend upon raising the parts and media from a normal first lower level to a second higher level and providing a screening member at said second higher level onto which the parts and media are displaced in response to continued vibratory action. The media is caused to sift through the screen for return by gravity to the first lower zone while the larger parts are retained on the surface of the screen for removal from the processing apparatus.

During displacement of the parts and media up the ramp and across the separating screen, the parts are exposed to a substantial amount of part-to-part contact and considerable energy is expended in raising the parts and media from the lower level to the upper level and onto the ramp.

Thus it is an object of this invention to provide a method which makes use of a bowl concept for the continuous circulation of parts and media in response to vibratory action, but in which in part-to-part impingement is markedly reduced, and separation is caused to take place at a level below normal level for parts and media thereby to reduce the amount of energy required and the harshness in the treatment of parts in the total operation for separation of the parts from the media.

These and other objects and advantages will hereinafter appear, and for purposes of illustration, but not of limitation, an embodiment of the invention is shown in the accompanying drawing in which.

Figure 3:
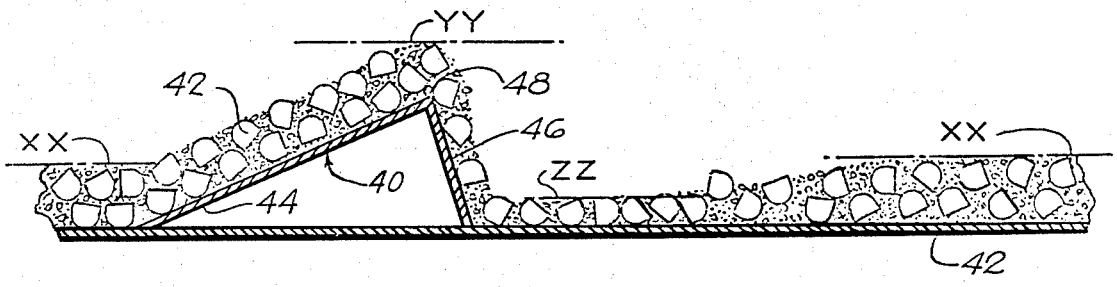
Figure 4:
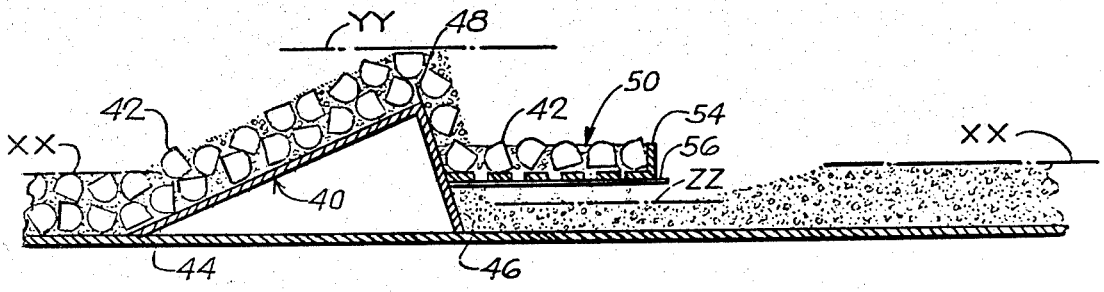

FIG. 3 is a side elevational view, partially in section, which schematically shows the flow of parts and media without screening for the separation of parts from the media; and FIG. 4 is a sectional elevational view similar to that of FIG. 3 which schematically shows the relationship between the elements when the separator screen is lowered into position of use for separation of the parts from the media.

Referring more specifically to the drawing, illustration is made of a vibratory device of the type described in which the features of this invention may be embodied, including a circular bowl 10 having a cross section in the form of an open-cup channel with a pair of axially spaced cylindrical sections, which form the curvilinear or straight vertically disposed side walls 12 and 14 joined at their lower ends by a curvilinear bottom wall 16.

A shaft 18 extends along the vertical axis of the bowl with means mounting the shaft for rotational movement by an electrical motor 20, preferably a variable speed motor, which is mounted by means of a suitable bracket 22 to the bowl 10 or frame. Eccentric weights 24 and 26 are fixed in vertically spaced-apart relation onto the shaft 18 to impart vibratory movement to the bowl in response to rotational movement of the shaft about its vertical axis. The bowl with its supported motor, eccentrics and shaft, is in turn supported by a plurality of circumferentially spaced coil springs 28 onto a base 30 which enables vibratory movement of the bowl relative to its support. During the finishing treatment, the parts and media are caused to travel in an orbital path in one direction about the bowl.

It has been observed that when a hurdle 40 is placed across the bowl, even when it extends from the bottom of the trough to a level below the normal height of the parts and media, the parts and media 42 pile up to a rather high level before passing over the barrier and then, as the parts and media clear the barrier 40, the level falls off almost precipitously to a level well below the normal height, after which it builds up gradually again to normal level as the parts and media continue to travel about the bowl in normal operation.

This phenomenon is illustrated in FIG. 3 wherein the barrier 40 is shown as a dam having a gradually inclined approach 44 and a sudden drop-off 46 from the apex 48. The normal height of the parts and media is indicated by the line XX. It will be seen that as the parts and media approach the barrier 40 which extends across the trough, the level of the parts and media begins to build up gradually to a maximum indicated by the line YY immediately in advance of the clearance of the barrier. As the parts and media clear the barrier, it will be seen that the level falls off rapidly to a level indicated by the line ZZ, which is far below the normal level XX.

It has been found that a separating screen 50 can be placed substantially as a continuation of the barrier 40 at a level below the normal level XX but above the drop-off level ZZ. Under these conditions, as the parts and media together clear the barrier 40, the parts and media are more or less laid onto the surface of the screen 50 where the media sifts through the screen while the parts are retained on the surface thereof. The screen should be dimensioned to have a length whereby the screening member terminates before the rise of the media to the level of the screening member, so that the media can continue to circulate with the added parts about the bowl without interference by the screen.

Means such as a chute 52 are provided to carry off the parts separated on the surface of the screen, as by providing a deflector 54 extending over the surface of the screen for displacement of the parts laterally over the surface through an aligned aperture through the outer side wall and onto the side delivery chute 52.

Figure 1:
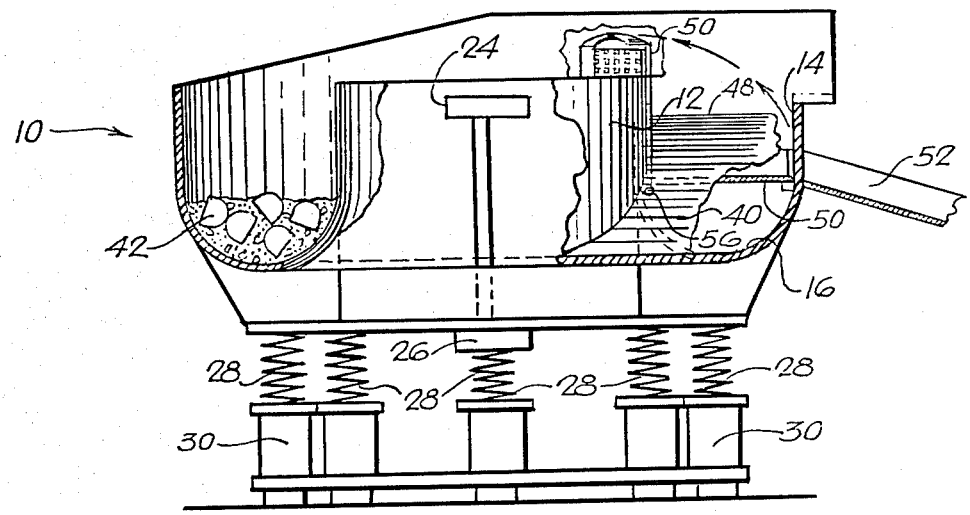
FIG. 1 is an elevational view partially in section of a vibratory device embodying the features of this invention.
Figure 2:
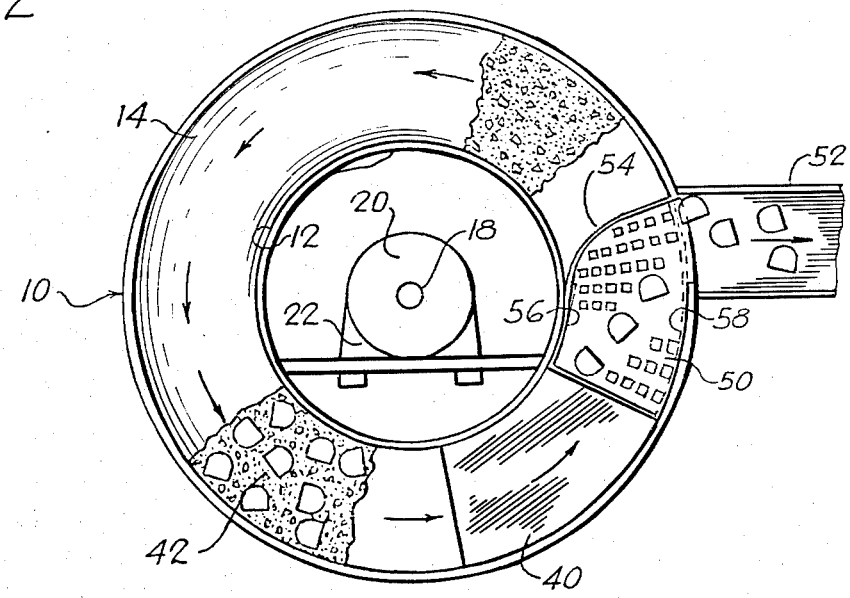
FIG. 2 is a top plan view of the device shown in FIG. 1.

The screening member 50 is fixed in position of use to extend crosswise of the trough but it is preferred that it be hinged, as at 56, to one side of the bowl for rocking movement between raised position out of the path of the parts and media, shown by broken lines in FIG. 1, and lowered position, shown by solid lines in FIG. 1, as a continuation of the barrier to receive the parts and media as they clear the barrier. An abutment 58 may be provided on the inner portion of the outer wall of the trough in position to be engaged by the outer edge of the screening member to extend horizontally across the trough when in lowered position. The screen is formed with openings dimensioned to be larger than that of the media but smaller than that of the parts to enable the media, broken-down media, dust, and dirt to sift through the screen while the parts are retained on the surface thereof.

In order to avoid entrapment of parts and/or media in advance of the barrier or dam, it is desirable to form the barrier with a gradual rise to the apex 48 and to locate the apex at a level which is betwen the normal level XX of the parts and media to one-half of the normal level of the parts and media in the bowl. It is also desirable to position the screen 50 below the apex 48 but above the level ZZ to which the parts and media fall upon clearance of the barrier.

It has been observed that the parts remain in admixture with the media throughout the entire period of rise to the higher level for clearance of the barrier, and after clearance until deposited on the screen member for separation. As a result, part-to-part impingement is minimized until the parts and media are deposited on the screen for separation.

It has also been observed that the location of the screening member 50 to below the level to which the parts and media rise for clearance of the barrier, and preferably below the apex of the barrier, eliminates the harshness to which the parts are exposed during processing and separation. It appears that the parts and media are gently laid upon the screen member thereby to avoid damage to such fragile parts as are formed of plastic material and the like.

In practice, the parts and media are loaded into the bowl in which they continue to circulate in response to vibratory action until the desired processing of the parts has been completed. Thereafter, the screening member is rocked from raised position to lowered position to extend across the trough. The parts and media are deposited on the screen upon clearing the barrier in response to continued vibratory action. The media sifts through the screen into the underlying portions of the bowl while the parts are retained on the surface of the screen for displacement to the delivery opening. The media continues to circulate about the bowl and additional parts or other parts are added for subsequent processing in another cycle of operation.

It will be understood that the barrier and screening section of the vibratory bowl may be embodied in a straight section of the bowl which extends as a cord between the remaining curvilinear portions of the bowl. By way of further modification, both the barrier 40 and screening member 50 may be hinged for rocking movement into and out of the path of the parts and media traveling about the bowl for uninterrupted movement until such time as it becomes desirable to separate the parts from the media or otherwise achieve a tumbling action within the bowl.

The device described provides for continuous operation in a manner which enables the parts to be efficiently processed and separated from the media as a continuous operation.

Included herein by reference is the application of Jones et al., filed concurrently herewith and entitled "A Vibratory Mill With Drainage and Classifying Means and Method", wherein description is made of the barrier with means embodied in the approach for the removal of fluids, particles of dust, dirt, and undersized media from the system.

It will be understood that changes may be made in the details of construction, arrangement, and operation, without departing from the spirit of the invention, especially as defined in the following claims.

I claim:

1. A method of treating the surface of parts comprising introducing said parts and a finishing media into a first zone at normal level, subjecting said mixture of parts and media to vibratory action whereby said parts and media travel in one direction in an orbital path, introducing a barrier across the path of travel of the parts and media whereby the parts and media pile up in advance of the barrier to an upper level above the normal level to clear the barrier, allowing the parts and media to fall sharply from the upper level to a lower level below normal level upon clearance of the barrier, screening the parts and media immediately beyond the barrier at a level below normal level but above the lower level to separate the parts on the surface of the screen while enabling the media to pass therethrough for return to normal level.

* * * * *